US010437166B2

(12) United States Patent
Shibata et al.

(10) Patent No.: US 10,437,166 B2
(45) Date of Patent: Oct. 8, 2019

(54) TWO-COMPONENT DEVELOPER FOR DEVELOPING ELECTROSTATIC LATENT IMAGE

(71) Applicant: Konica Minolta, Inc., Tokyo (JP)

(72) Inventors: Koji Shibata, Hachioji (JP); Shinya Obara, Fuchu (JP); Satoshi Uchino, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/138,485

(22) Filed: Sep. 21, 2018

(65) Prior Publication Data

US 2019/0137902 A1 May 9, 2019

(30) Foreign Application Priority Data

Nov. 9, 2017 (JP) ..... 2017-216025

(51) Int. Cl.

| | |
|---|---|
| ***G03G 9/08*** | (2006.01) |
| ***G03G 9/113*** | (2006.01) |
| ***G03G 9/107*** | (2006.01) |
| ***G03G 9/087*** | (2006.01) |
| ***G03G 9/083*** | (2006.01) |
| ***G03G 9/097*** | (2006.01) |

(52) U.S. Cl.

CPC ..... *G03G 9/1133* (2013.01); *G03G 9/0819* (2013.01); *G03G 9/0823* (2013.01); *G03G 9/0834* (2013.01); *G03G 9/08755* (2013.01); *G03G 9/09708* (2013.01); *G03G 9/09716* (2013.01); *G03G 9/1075* (2013.01); *G03G 9/1139* (2013.01); *G03G 9/0827* (2013.01)

(58) Field of Classification Search

CPC ... G03G 9/1133; G03G 9/1139; G03G 9/1075
USPC ..... 430/110.2, 111.4, 111.32, 111.33, 111.35
See application file for complete search history.

(56) References Cited

U.S. PATENT DOCUMENTS

2009/0245858 A1* 10/2009 Mizutani ..... G03G 9/0804 399/111

FOREIGN PATENT DOCUMENTS

JP 2015230376 A 12/2015

* cited by examiner

*Primary Examiner* — Mark A Chapman
(74) *Attorney, Agent, or Firm* — Lucas & Mercanti, LLP

(57) ABSTRACT

Provided is a two-component developer for developing an electrostatic latent image incorporating: toner particles each containing a toner mother particle having an external additive on a surface of the toner mother particle; and carrier particles each having a core material particle and a covering layer containing a resin on a surface of the core material particle, wherein the external additive contains inorganic particles; the inorganic particles are subjected to surface modification with silicone oil; a carbon content remained on a surface of the inorganic particle after the surface modification is within 3.0 to 10.0 mass %; a free carbon ratio on the surface of the inorganic particle is 70.0% or more; the carrier particles have a resistance in the range of $1.0\times10^{9}$ to $5.0\times10^{10}$ Ω·cm; and the resin in the covering layer contains a resin formed from a monomer containing an alicyclic methacrylic acid ester monomer.

9 Claims, 2 Drawing Sheets

TWO-COMPONENT DEVELOPER FOR DEVELOPING ELECTROSTATIC LATENT IMAGE

Japanese Patent Application No. 2017-216025, filed on Nov. 9, 2017 with Japan Patent Office, is incorporated herein by reference in its entirety.

TECHNICAL FIELD

The present invention relates to a two-component developer for developing an electrostatic latent image. More specifically, the resent invention relates to a two-component developer for developing an electrostatic latent image which enables to prevent generation of lead portion whitening at an initial stage, and to prevent occurrence of development leak even when it is used for a long time.

BACKGROUND

In image formation by an electrophotographic method, an electrostatic latent image formed on an image carrier (it is also called as a photoreceptor) is developed with a toner to result in visualization. As this developing method, conventionally, two method s are known depending on the rotating direction of a developing sleeve of the developing unit that rotates while holding the developer and the rotating direction of the photoreceptor. One is a normal-rotation developing method, and the other is a reverse-rotation developing method.

As illustrated in FIG. 1A, the normal-rotation developing method is a developing method in which the rotating direction W1 of the photoreceptor P and the rotating direction W2 of the developing sleeve S are an opposite direction. In this method, in the development area, the surface of the photoreceptor and the developer on the surface of the developing sleeve are brought into contact with each other from the same direction, thereby development is carried out.

On the other hand, as illustrated in FIG. 1B, the reverse-rotation developing method is a developing method in which the rotating direction W1 of the photoreceptor P and the rotating direction W2 of the developing sleeve S are the same direction. In this method, in the development area, the surface of the photoreceptor and the developer on the surface of the developing sleeve are brought into contact with each other from the opposite direction, thereby development is carried out.

The normal-rotation developing method and the reverse-rotation developing method both produce a scavenging phenomenon, that is, a phenomenon which disturbs the toner image developed on the photoreceptor by electrostatically scraping the toner with the carrier particles. In particular, an image defect caused by scavenging is easily produced in the normal-rotation developing method.

A specific example of the above-described image defect caused by the scavenging phenomenon is described by referring to FIG. 2. FIG. 2 is a schematic diagram illustrating an image defect that occurred when printing a document having a solid image G1 adjacent to the rear end of the halftone image G2 with respect to the paper feeding direction A. When such printing is performed, as illustrated in the figure, the halftone image of the rear edge of the halftone image, that is, the boundary W with respect to the solid image is likely to be whitened easily (hereinafter referred to as "lead portion whitening" or "lead portion white spot"). Improvement thereof is required.

The cause of the scavenging phenomenon is the difference in moving speed between the developing sleeve and the photoreceptor. The scavenging phenomenon occurs when the moving speed of the developing sleeve is set higher than the moving speed of the photoreceptor. More specifically, the scavenging phenomenon occurs as follows. When a solid image is developed, a large amount of toner is supplied to the photoconductor, whereby charges remain in the carrier particles on the developing sleeve, and the carrier particles overtake the solid image portion on the photoreceptor. When the carrier particles reach the halftone image part, a scavenging phenomenon occurs because the toner that forms the halftone image is electrostatically scraped off.

As an improvement method for suppressing the occurrence of the scavenging phenomenon, reduction in resistance of carrier particles has been proposed. By making the carrier particles to have low resistance, charge of the carrier particles generated at the time of solid image development tends to disappear easily. As a result, the toner is not scraped off, and the scavenging phenomenon hardly occurs.

However, when the resistance of the initial carrier particles is excessively lowered, the resin layer on the surface of the carrier particles is scraped and the core material having lower resistance is exposed on the surface, so that the resistance excessively decreases and the development nip portion leakage occurs, and a problem arises that image defects are likely to occur (for example, refer to Patent document 1: JP-A 2015-230376).

Therefore, in general, it is difficult to make it compatible with suppression of occurrence of lead portion whitening at an initial stage and suppression of occurrence of development leakage when the photoreceptor is used for a long time.

SUMMARY

The present invention was done based on the above-described problems and situations. An object of the present invention is to provide a two-component developer for developing an electrostatic latent image which enables to prevent generation of lead portion whitening at an initial stage, and to prevent occurrence of development leakage even when the developer is used for a long time.

In order to solve the above-mentioned problem, the present inventors examined the cause of the above problem. And the present invention was achieved by the following developer. An aspect of the developer of the present invention is a two-component developer for developing an electrostatic latent image comprising toner particles and carrier particles, wherein inorganic particles contained in an external additive of the toner particles are surface-modified with silicone oil; a carbon content remained on the surface of the inorganic particles after surface-modified is made to be in the predetermined range; a free carbon ratio is made to be in the predetermined range; a resistance of the carrier particles is made to be in the predetermined range; and a covering layer of the carrier particles is made to contain a resin formed from a monomer containing an alicyclic methacrylic acid ester monomer. By using this developer, it is possible to prevent generation of lead portion whitening at an initial stage, and to prevent occurrence of development leakage even when the developer is used for a long time. Namely, the object of the present invention is solved by the following embodiments.

An aspect of a two-component developer for developing an electrostatic latent image according to the present invention comprises:

toner particles each containing a toner mother particle having an external additive on a surface of the toner mother particle; and carrier particles each having a core material particle and a covering layer containing a resin on a surface of the core material particle, wherein the external additive contains inorganic particles;

the inorganic particles are subjected to surface modification with silicone oil;

a carbon content remained on a surface of the inorganic particle after the surface modification is in the range of 3.0 to 10.0 mass %;

a free carbon ratio on the surface of the inorganic particle is 70.0% or more;

the carrier particles have a resistance in the range of $1.0\times10^9$ to $5.0\times10^{10}$ Ω·cm; and the resin in the covering layer contains a resin formed from a monomer containing an alicyclic methacrylic acid ester monomer.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF THE EMBODIMENTS

Figure 1A:
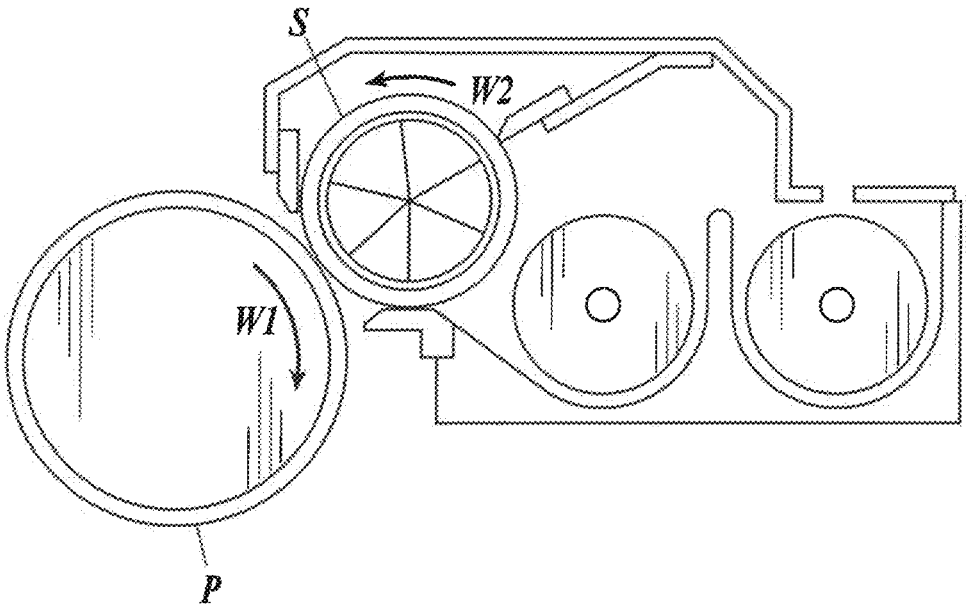
FIG. 1A is a schematic drawing for explaining a normal-rotation developing method.
Figure 1B:
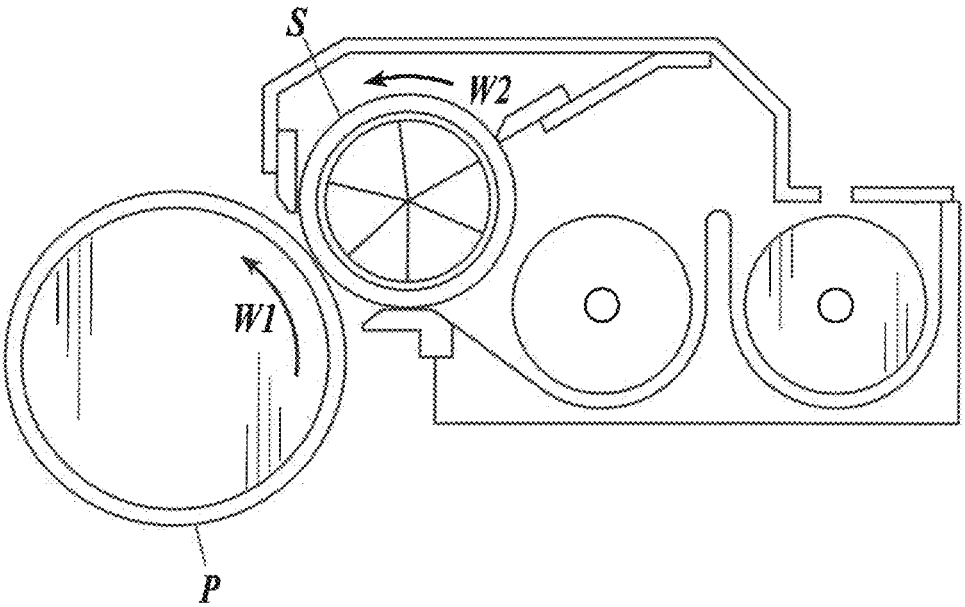
FIG. 1B is a schematic drawing for explaining a reverse-rotation developing method.
Figure 2:
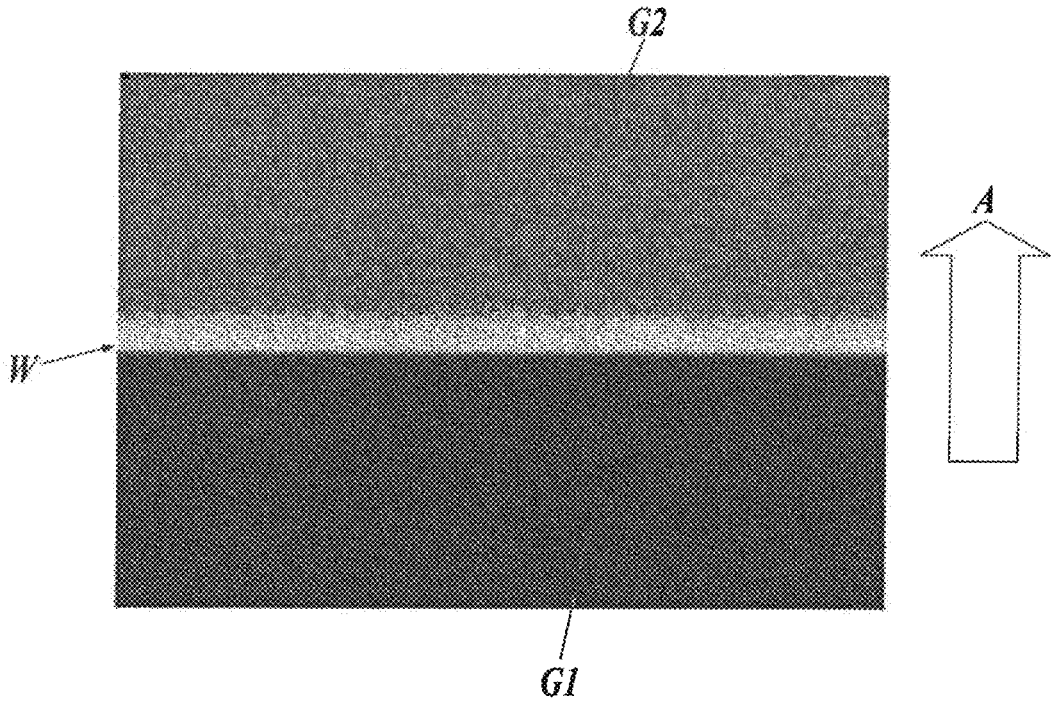
FIG. 2 is a schematic drawing for explaining a scavenging phenomenon.

Hereinafter, one or more embodiments of the present invention will be described with reference to the drawings. However, the scope of the invention is not limited to the disclosed embodiments.

According to the present invention, it is possible to provide a two-component developer for developing an electrostatic latent image which enables to prevent generation of lead portion whitening at an initial stage, and also to prevent occurrence of development leakage even when it is used for a long time. An expression mechanism or an action mechanism of the effects of the present invention is not clearly identified, but it is supposed as follows.

The lead portion whitening is most easily to occur at an initial stage having a high resistance. Therefore, it is assumed that the lead portion whitening is prevented by controlling the carrier particles at an initial stage to have a resistance in the range of $1.0\times10^9$ to $5.0\times10^{10}$ Ω·cm.

When the developer is used for a long time, the silicon oil is transferred from the inorganic particles, which are used as an external additive, to the carrier particles. Thereby it is supposed that the resistance change of the carrier particles is prevented and occurrence of development leakage may be prevented even when the developer is used for a long time.

The external additive according to the present invention has a carbon content remained on a surface of the inorganic particles after surface modification with silicone oil is in the range of 3.0 to 10.0 mass %. By making the carbon content to be 3.0 mass % or more, the effect caused by incorporation of the silicone oil may be easily obtained. By making the carbon content to be 10.0 mass % or less, excessive transfer amount of the silicone oil from the inorganic particles to the carrier particles may be prevented, and it may be prevented generation of the lead portion whitening.

Further, the external additive according to the present invention has a free carbon ratio on the surface of the inorganic particles after surface modification with silicone oil is 70.0% or more. By making the free carbon ratio to be 70.0% or more, the silicone oil may be effectively transferred to the carrier particle, whereby the effect of the present invention may be efficiently obtained.

The resin that covers the carrier particle according to the present invention contains a resin formed from a monomer containing an alicyclic methacrylic acid ester monomer. This resin has relatively a high hydrophobic property. As a result, it is assumed that the silicone oil was not transferred too much, and it was possible to transfer a moderate amount of silicone oil from the inorganic particles used as an external additive to the carrier particles.

Hence, by obtaining the above-mentioned effects, the two-component developer for developing an electrostatic latent image of the present invention is supposed to be capable of suppressing the occurrence of white spots at the initial stage of the lead portion and is capable of preventing occurrence of development leakage even when the developer is used for a long time.

A two-component developer for developing an electrostatic latent image according to the present invention comprises:

toner particles each containing a toner mother particle having an external additive on a surface of the toner mother particle; and carrier particles each having a core material particle and a covering layer containing a resin on a surface of the core material particle, wherein the external additive contains inorganic particles;

the inorganic particles are subjected to surface modification with silicone oil;

a carbon content remained on a surface of the inorganic particle after the surface modification is in the range of 3.0 to 10.0 mass %;

a free carbon ratio on the surface of the inorganic particle is 70.0% or more;

the carrier particles have a resistance in the range of $1.0\times10^9$ to $5.0\times10^{10}$ Ω·cm; and the resin in the covering layer contains a resin formed from a monomer containing an alicyclic methacrylic acid ester monomer. This feature is a technical feature common or corresponding to the following embodiments.

As an embodiment of the present invention, it is preferable that the aforesaid silicone oil is dimethyl silicone oil from the viewpoint of cost and easy handling.

As an embodiment of the present invention, it is preferable that the aforesaid silicone oil has a kinetic viscosity in the range of 50 to 500 $mm^2/s$ at 25° C. from the viewpoint of effectively obtaining the effect of the present invention. When the kinetic viscosity at 25° C. is 50 $mm^2/s$ or more, the silicone oil will be easily transferred to the carrier particles to result in exhibiting a sufficient function of the silicone oil. When the kinetic viscosity at 25° C. is 500 $mm^2/s$ or less, the silicone oil transferred to the carrier particles will remain on the carrier particles to result in exhibiting a sufficient function of the silicone oil.

As an embodiment of the present invention, it is preferable that the aforesaid inorganic particles have a number average primary-particle diameter in the range of 25 to 100 nm from the viewpoint of effectively obtaining the effect of the present invention. When the inorganic fine particles have a number average primary-particle diameter of 25 nm or more, they easily contact with a carrier particle even when the surface of the toner mother particle has some irregularity. Consequently, the silicone oil will be easily transferred to the carrier particle to result in exhibiting a sufficient function of the silicone oil. When the inorganic fine particles have a number average primary-particle diameter of 100 nm or less, the amount of the inorganic fine particles existing on the surface of the toner mother particle may be easily maintained. Consequently, the silicone oil will be easily transferred to the carrier particle to result in exhibiting a sufficient function of the silicone oil.

As an embodiment of the present invention, it is preferable that the aforesaid inorganic particles are at least one of silica particles and aluminum oxide particles from the viewpoint of effectively obtaining the effect of the present invention.

As an embodiment of the present invention, it is preferable that the aforesaid core material particles in the carrier particles have a resistance in the range of $8.0\times10^{6}$ to $3.0\times10^{8}$ Ω·cm from the viewpoint of effectively obtaining the effect of the present invention. By making the carrier particles to have a resistance of $8.0\times10^{6}$ Ω·cm or more, the resistance change of the carrier particles is prevented and occurrence of development leakage may be prevented even when the developer is used for a long time. By making the carrier particles to have a resistance of $3.0\times10^{8}$ Ω·cm or less, it is possible to ensure the charge mobility in the carrier particles and to easily suppress occurrence of whitening in the lead portion.

As an embodiment of the present invention, it is preferable that the aforesaid carrier particles have a resistance in the range of $5.0\times10^{9}$ to $2.0\times10^{10}$ Ω·cm from the viewpoint of effectively obtaining the effect of the present invention.

As an embodiment of the present invention, it is preferable that the aforesaid covering layer is solely consisted of the resin formed from a monomer containing an alicyclic methacrylic acid ester monomer. When the surface of the core material particles does not have a component (other than the resin) that controls the resistance, the component that controls the resistance will not come into contact with the carrier particle even when the developer is used for a long time. It is easy to suppress the resistance change of the carrier particles, and as a result, occurrence of development leakage may be easily suppressed even when used for a long time.

As an embodiment of the present invention, it is preferable that a content of the alicyclic methacrylic acid ester monomer that forms the aforesaid covering layer is in the range of 25 to 75 mass %. By making the content to be 25 mass % or more, it is possible to sufficiently exhibit the effect caused by incorporation of silicone oil. By making the content to be 75 mass % or less, it is possible that the film strength is hardly decreased even when silicone oil is contained, and the fluctuation range of resistance of carrier particles can be reduced even when it is used for a long time.

Hereinafter, the present invention, its constituent elements, and forms and embodiments for carrying out the present invention will be described in detail. In the present application, "to" for indicating a numerical range is used to include numerical values described before and after the numerical range as a lower limit value and an upper limit value.

[Two-Component Developer for Developing an Electrostatic Latent Image]

A two-component developer for developing an electrostatic latent image of the present invention (hereinafter, it may be simply called as "two-component developer" or "developer") comprises: toner particles each containing a toner mother particle having an external additive on a surface of the toner mother particle; and carrier particles each having a core material particle and a covering layer containing a resin on a surface of the core material particle. In the developer, the external additive contains inorganic particles; the inorganic particles are subjected to surface modification with silicone oil; a carbon content remained on a surface of the inorganic particle after surface modification is in the range of 3.0 to 10.0 mass %; a free carbon ratio on the surface of the inorganic particle is 70.0% or more; the carrier particles have a resistance in the range of $1.0\times10^{9}$ to $5.0\times10^{10}$ Ω·cm; and the resin in the covering layer contains a resin formed from a monomer containing an alicyclic methacrylic acid ester monomer.

It is possible to obtain a two-component developer by mixing the toner particles and the carrier particles according to the present invention. The mixing apparatus used for mixing is not particularly limited, and examples thereof include a Nauta mixer, a Double cone mixer, and a V mixer. The content (toner concentration) of the toner in the two-component developer is not particularly limited, but from the viewpoint of effectively obtaining the effect of the present invention, the content is preferably in the range of 4.0 to 8.0 mass %.

<Carrier Particles>

The carrier particles according to the present invention are coated carrier particles having core material particles and a resin layer covering the surface of the core material particles.

The carrier particles according to the present invention have a resistance in the range of $1.0\times10^{9}$ to $5.0\times10^{10}$ Ω·cm. More preferably, the resistance is in the range of $5.0\times10^{9}$ to $2.0\times10^{10}$ Ω·cm.

When the resistance is less than $1.0\times10^{9}$ Ω·cm, since the initial carrier resistance is too low, development leakage tends to occur due to long-term use. When the resistance is more than $5.0\times10^{10}$ Ω·cm, the carrier resistance is so high that initial lead portion whitening is likely to occur.

The resistance of the carrier particles in the present invention indicates the resistance of the carrier particles obtained by separating the toner particles from the developer at the start of use of the carrier particles. The resistance is measured by a resistance measuring method to be described later. The resistance of the carrier particles in the present invention is the resistance that is dynamically measured under the developing condition by the magnetic brush. An aluminum electrode drum having the same size as the photosensitive drum is replaced with the photosensitive drum. Then, the carrier particles are supplied onto the developing sleeve to form a magnetic brush. The formed magnetic brush is rubbed against the electrode drum. A voltage (500 V) is applied between the developing sleeve and the electrode drum to measure the current flowing therebetween. The resistance of the carrier particles is obtained by the following expression.

$$DVR(\Omega\cdot\mathrm{cm})=(V/I)\times(N\times L/Dsd)$$

In the aforesaid expression, the symbols indicate the following.

DVR: Resistance of carrier particles (Ω·cm)

V: Voltage between the developing sleeve and the electrode drum (V)

I: Measured electric current (A)

N: Developing nip width (cm)

L: Developing sleeve length (cm)

Dsd: Distance between the developing sleeve and the electrode drum (cm)

In the present invention, the measurement was done with the conditions of: V=500V, N=1 cm, L=6 cm, and Dsd=0.6 mm.

It is preferable that the carrier particles have a volume-based median diameter in the range of 10 to 100 μm, more preferably 20 to 80 μm. The volume-based median diameter of the carrier particles may be measured by a laser diffraction particle size analyzer "HELOS" (manufactured by SYMPAIEC GmbH) including a wet dispersion device.

<Core Material Particles>

Examples of the core material particles (magnetic particles) used in the present invention include: iron powders, magnetite, various ferrite particles, and the material in which these substances are dispersed in a resin. Among them, it is preferable to use magnetite or various ferrite particles. Preferable ferrites are: ferrite containing metals such as copper, zinc, nickel, and manganese; and light metal ferrite containing an alkali metal and/or an alkaline earth metal. In addition, it is preferable that strontium (Sr) is contained as the core material particle. By containing strontium, irregularities on the surface of the core material particles can be increased, and even when the resin is coated, the surface is more likely to be exposed and the resistance of the carrier particles can be easily adjusted.

The resistance of the core material particles is preferably in the range of $8.0\times10^6$ to $3.0\times10^8$ Ω·cm from the viewpoint of more effectively obtaining the effect of the present invention. By making the resistance of the core material particles to $8.0\times10^6$ Ω·cm or more, fluctuation of the resistance is reduced even after prolonged use, and occurrence of development leakage is easily suppressed. Further, by making the resistance of the core material particles to $3.0\times10^6$ Ω·cm or less, charge mobility in the carrier particles is secured and occurrence of the lead portion whitening is easily suppressed.

The resistance of the core material particles may be adjusted by the oxide film treatment described in the method for producing the core material particles described later.

When the resistance of the core material particles is measured, only the coating layer is removed by dissolving or decomposing with heat. After separating the core material particles, measurement may be done by the same method as the resistance measurement method of the carrier particles.

(Shape of Core Material Particles)

The shape factor (SF-1) of the core material particles is preferably in the range of 110 to 150. The shape factor may be adjusted, for example, by changing the kind and amount of the element contained in the core material particles, and the firing temperature in the production process described later.

The shape factor (SF-1) of the core material particle is a numerical value calculated by the following Equation 1.

$$\text{Shape factor (SF-1)} = (\text{Maximum length of core material particle})^2/(\text{Projected area of core material particle})\times(\pi/4)\times100 \quad \text{Equation 1:}$$

First, the measurement method of the shape factor (SF-1) of the core material particles will be described. In measuring the shape factor (SF-1) of the core material particles, carrier particles are prepared, but when the sample is a developer instead of the single carrier particles, an advance preparation is carried out.

Add a developer, a small amount of neutral detergent, pure water into a beaker and allow the mixture to spread well, and throw the supernatant while placing the magnet at the bottom of the beaker. Further, pure water is added and the supernatant liquid is discarded, so that only the carrier particles are separated by removing the toner and the neutral detergent. And the sample is dried at 40° C. to obtain a single carrier particle.

Subsequently, in order to remove the resin coating layer, the coating resin layer is dissolved in a solvent and removed.

2 g of carrier particles are put into a 20 mL glass bottle, then, 15 mL of methyl ethyl ketone is put into the glass bottle, the mixture is stirred with a wave rotor for 10 minutes, and the resin coating layer is dissolved with a solvent. The solvent is removed using a magnet, and the core material particles are washed three times with 10 mL of methyl ethyl ketone. The washed core material particles are dried to obtain the core material particles. In the present invention, the term "core material particle" refers to the particle after carrying out this pretreatment.

Photographs of arbitral 100 or more core material particles of are taken at a magnification of 150 times with a scanning electron microscope, and a photographic image captured by a scanner was analyzed using an image processing analyzer LUZEX AP (manufactured by Nireco Corporation). The number average particle diameter is calculated as the average value of the horizontal direction Feret diameter, and the shape coefficient is a value calculated from the average value of the shape coefficients calculated by Equation 1 described above.

(Particle Diameter and Magnetization Characteristic of Core Material Particle)

The particle diameter of the core material particles is preferably in the range of 10 to 100 μm, more preferably in the range of 20 to 80 μm, as the volume average particle diameter. The volume average particle diameter of the core material particles is an average particle diameter based on volume.

The volume-based median diameter of the core material particles may be measured by a laser diffraction particle size analyzer "HELOS" (manufactured by SYMPATEC GmbH) including a wet dispersion device.

The magnetization characteristics of the core material particles are preferably in the range of $2.5\times10^{-5}$ to $15.0\times10^{-5}$ Wb·m/kg in terms of saturation magnetization.

The saturation magnetization can be measured by, for example, "DC magnetization characteristic automatic recording apparatus 3257-35" (manufactured by Yokogawa Electric Corporation).

(Production Method of Core Material Particles)

After weighing an appropriate amount of the raw material, it is pulverized and mixed preferably for 0.5 hour or more, more preferably for 1 to 20 hours with a wet media mill, a ball mill, or a vibration mill. The pulverized material thus obtained was pelletized using a pressure molding machine. Thereafter, it is preferably calcined at a temperature of 700 to 1200° C., preferably for 0.5 to 5 hours.

Here, instead of using a compression molding machine, after grinding, water may be added to make a slurry and granulated by using a spray dryer. After preliminary firing the mixture is further pulverized with a ball mill or a vibration mill. Subsequently, water and, if necessary, a dispersant, a binder such as polyvinyl alcohol (PVA) are added to the mixture to adjust the viscosity, and it is granulated. Then, main firing is performed. The main firing temperature is preferably 1000 to 1500° C., and the main firing time is preferably 1 to 24 hours. When pulverizing is done after the preliminary firing, water may be added and pulverized with a wet ball mill or a wet vibration mill.

The pulverizer such as the above-mentioned ball mill and vibration mill is not particularly limited, but in order to effectively and uniformly disperse the raw materials, it is preferable to use fine beads having a particle diameter of 1 cm or less in the medium to be used. Further, by adjusting the diameter, composition, and pulverization time of the beads to be used, the degree of pulverization can be controlled.

The fired product thus obtained is pulverized and classified. As a classification method, the particle diameter is adjusted to a desired particle size by using known wind classification method, mesh filtration method, or precipitation method.

Thereafter, if necessary, resistance adjustment can be carried out by subjecting the surface to low temperature heating and applying an oxide film treatment. The oxide coating treatment may be performed at a temperature of, for example, 300 to 700° C. by using a general rotary electric furnace, or a batch type electric furnace. The thickness of the oxide film formed by this treatment is preferably 0.1 μm to 5 μm. When the thickness of the oxide film is within the above range, the effect of the oxide film layer is obtained, and it is preferable since the desired characteristic may be easily obtained because the oxide film thickness does not become too high. If necessary, reduction may be performed before the oxide coating treatment. Also, after classification, low magnetic products may be further separated by magnetic separation.

<Covering Layer>

In addition, the resin that coats the carrier particles according to the present invention contains a resin formed from a monomer containing an alicyclic methacrylic acid ester monomer having a relatively high hydrophobicity. As a result, it is presumed that the silicone oil did not migrate too much, and it was possible to transfer a moderate amount of silicone oil from the inorganic fine particles as external additives to the carrier particles.

Hereinafter, the alicyclic (meth) acrylate compound which is "a resin formed from a monomer containing an alicyclic methacrylic acid ester monomer" preferably used in the present invention will be described.

From the viewpoints of the mechanical strength, the environmental stability of the charge amount (the environmental difference of the charge amount is small), the ease of polymerization and the availability, the alicyclic (meth) acrylate compound is preferably a compound containing a cycloalkyl group having 5 to 8 carbon atoms. The alicyclic (meth) acrylic acid ester compound is preferably at least one selected from the group consisting of cyclopentyl (meth) acrylate, cyclohexyl (meth)acrylate, cycloheptyl (meth) acrylate and cyclooctyl (meth)acrylate. Among these, cyclohexyl (meth)acrylate is preferably contained from the viewpoint of mechanical strength and environmental stability of the charge amount. Further, a copolymer of an alicyclic (meth) acrylate compound and methyl methacrylate is more preferable. This is because film strength is further increased by using methyl methacrylate.

The content of the alicyclic methacrylic acid ester monomer that forms the covering layer is preferably in the range of 25 to 75 mass % with respect to the total amount of the coating layer. When the content is 25% mass % or more, the effect of containing the silicone oil may be sufficiently exhibited. In addition, when the content is 75 mass % or less, the film strength is hardly lowered even when silicone oil is contained, the fluctuation range of resistance of carrier particles may be reduced and even when used for a long period of time.

The number of addition portions of the resin that forms the covering layer to the core material particles is preferably 1 part or more and 5 parts or less, more preferably 1.5 parts or more and 4 parts or less. When the amount is less than 1 part, it becomes difficult to retain the charge amount, whereas when it is more than 5 parts, the resistance becomes too high.

The covering layer according to the present invention is preferably composed only of a resin formed from a monomer containing an alicyclic methacrylic acid ester monomer. When the surface of the core material particle does not contain a component for adjusting the resistance other than the resin, even when it is used for a long time, the component which adjusts the resistance located apart from the core material particle together with the resin will never come into contact with the carrier particle. Consequently, it is easy to suppress the resistance variation of the carrier particles, and as a result, occurrence of development leakage may be easily suppressed even when used for a long time.

(Method for Forming Covering Layer)

Specific examples of the method for producing the covering layer include a wet coating method and a dry coating method. Although each method will be described below, a dry coating method is a particularly desirable method for applying to the present invention, and it is described in detail.

As the wet coating method, a fluidized bed spray coating method, an immersion coating method, and a polymerization method may be mentioned.

The fluidized bed type spray coating method is a method in which a coating solution prepared by dissolving a coating resin in a solvent is sprayed onto the surface of core material particles using a fluidized bed and then dried to prepare a coating layer.

The immersion type coating method is a method in which core material particles are immersed in a coating solution prepared by dissolving a coating resin in a solvent and coated, followed by drying to prepare a covering layer.

The polymerization method is a method of preparing a covering layer by coating core material particles in a coating solution prepared by dissolving a reactive compound in a solvent, applying a coating treatment, and then applying heat to carry out a polymerization reaction.

Next, the dry coating method will be described. In the dry coating method, for example, resin particles are deposited on the surface of the particles to be coated and then mechanical impact force is applied to melt or soften the resin particles adhered to the surface of the particles to be coated to fix them. Thereby a covering layer is formed.

The core material particles, the resin, and the low resistance fine particles are agitated at high speed using a high speed stirring mixer capable of applying a mechanical impact force under non-heating or heating condition. Then, by imparting an impulsive force repeatedly to the mixture, and by dissolving or softening it on the surface of the core material particle, fixed carrier particles are produced. As the coating condition, when heating, the temperature is preferably 80 to 130° C. The wind speed which generates the impact force is preferably 10 m/s or more during heating, and 5 m/s or less in order to suppress the aggregation of the carrier particles at the time of cooling. The time for imparting the impact force is preferably 20 to 60 minutes.

Next, in the step of coating the resin or in the step after coating, a method of stripping the resin at the convex portions of the core material particles by applying stress to the carrier particles and exposing the core material particles will be described.

In the resin coating process by the dry coating method, peeling of the resin may be caused by lowering the heating temperature to 60° C. or less while making the wind speed during cooling to be high shear. In addition, as a process after coating, it is possible to use any apparatus which is capable of performing forced stirring. For example, stirring and mixing with a turbular, a ball mill, or a vibration mill may be mentioned.

In addition, as a method of exposing the core material by moving the resin on the surface of the convex portion toward the concave side by applying heat and impact to the coating resin, it is effective to take a long time to impart the impact force. Specifically, it is preferable to set it to 1.5 hour or more.

<Toner>

In the present invention, the term "toner" refers to aggregation of "toner particles". The particles contain at least toner mother particles, and the toner particles indicate the toner mother particles or a substance containing the toner mother particles added with an external additive.

<Toner Mother Particles>

It is preferable that the binder resin included in the toner mother particles according to the present invention contains an amorphous resin and a crystalline resin. The toner mother particles may contain other components such as a colorant, a mold release agent (wax), and a charge controlling agent, when needed.

When the toner mother particles are used by mixing with the crystalline resin and the amorphous resin described in detail below, the crystalline resin and the amorphous resin are solubilized at the time of heat fixing. As a result, low temperature fixing of the toner is achieved, and energy saving is achieved.

The toner according to the present invention may be prepared by any known process. Examples of the process include a kneading pulverization method, a suspension polymerization method, an emulsion aggregation method, a dissolution suspension method, a polyester extension method, and a dispersion polymerization method. Among these processes, preferred is an emulsion aggregation method, in view of the uniformity of the particle diameter and control of the shape of the toner.

<Amorphous Resin>

Commonly known amorphous resins in this technical field may be used. In particular, it is preferable that the amorphous resin contain an amorphous vinyl resin. The most preferable is a styrene-acrylic co-polymer resin that is formed by using a styrene monomer and a (meth)acrylate monomer or acrylic acid. When a toner is produced by making emulsion aggregation of the styrene-acrylic resin, the water content in the toner is suitably increased, and adhesion force of the toner to the photoreceptor is increased. Thus, the toner will hardly detached from the photoreceptor and the scavenging may be prevented.

As a vinyl monomer that forms an amorphous vinyl polymer, the following may be used. The vinyl monomers may be used alone, or may be used in combination of two or more kinds.

(1) Styrene Monomers

Examples of the styrene monomer are: styrene, o-methylstyrene, m-methylstyrene, p-methylstyrene, α-methylstyrene, p-chlorostyrene, 3,4-dichlorostyrene, p-phenylstyrene, p-ethylstyrene, 2,4-dimethylstyrene, p-t-butylstyrene, p-n-hexylstyrene, p-n-octylstyrene, p-n-nonylstyrene, p-n-decylstyrene, p-n-dodecylstyrene, and derivatives of these monomers.

(2) (Meth)Acrylic Acid Ester Monomers

Examples of the (meth)acrylic acid ester monomer are: methyl (meth)acrylate, ethyl (meth)acrylate, n-butyl (meth) acrylate, iso-propyl (meth)acrylate, iso-butyl (meth)acrylate, t-butyl (meth)acrylate, n-octyl (meth)acrylate, 2-ethylhexyl (meth)acrylate, stearyl (meth)acrylate, lauryl (meth) acrylate, phenyl (meth)acrylate, diethylaminoethyl (meth) acrylate and dimethylaminoethyl (meth)acrylate, and derivatives of these monomers.

(3) Vinyl Esters

Examples of the vinyl ester are: vinyl propionate, vinyl acetate, and vinyl benzoate.

(4) Vinyl Ethers

Vinyl methyl ether and vinyl ethyl ether (5) Vinyl Ketones

Examples of the vinyl methyl ketone are: vinyl ethyl ketone and vinyl hexyl ketone.

(6) N-Vinyl Compounds

Examples of the N-vinyl carbazole are: N-vinyl indole, and N-vinyl pyrrolidone.

(7) Others

Vinyl compounds such as vinylnaphthalene and vinylpyridine; acrylic acid or methacrylic acid derivatives such as acrylonitrile, methacrylonitrile, and acrylamide are also used.

It is preferable to use a vinyl monomer containing an ionic dissociation group such as a carboxy group, a sulfonic acid group or a phosphoric acid group.

Examples of the monomer containing a carboxy group are: acrylic acid, methacrylic acid, maleic acid, itaconic acid, cinnamic acid, fumaric acid, monoalkyl maleate, and monoalkyl itaconate. Examples of the monomer containing a sulfonic acid group are: styrenesulfonic acid, allylsulfosuccinic acid, and 2-acrylamido-2-methylpropanesulfonic acid. An example of a monomer containing a phosphoric acid group is acid phosphooxyethyl methacrylate.

Further, the amorphous vinyl polymer may be changed into a cross-linked resin by using a poly-functional vinyl compound as a vinyl monomer. Examples of the poly-functional vinyl compound include: divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentylglycol dimethacrylate, and neopentylglycol diacrylate.

As described above, the vinyl resins are described in detail as a preferred embodiment of an amorphous resin. The present invention is not limited to the vinyl resins. An amorphous polyester resin may be also used.

<Crystalline Resin>

In this specification, the crystalline resin indicates a resin having a distinct endothermic peak, rather than a stepwise endothermic change, in differential scanning calorimetry (DSC). The distinct endothermic peak indicates an endothermic peak having a half width within 15° C. or less at a heating rate of 10° C./min in the DSC.

Any crystalline resin having these characteristics may be used. Commonly known crystalline resins in this technical field may be used. Specific examples of the crystalline resins include: a crystalline polyester resin, a crystalline polyurethane resin, a crystalline polyurea resin, a crystalline polyamide resin, and a crystalline polyether. These crystalline resins may be used alone or in combination of two or more kinds.

Among these crystalline resins, crystalline polyester resins are preferable. In this specification, the "crystalline polyester resin" indicates a resin satisfying the endothermic characteristics described above among known polyester resins prepared by a polycondensation reaction of a di- or higher-valent carboxylic acid (polyvalent carboxylic acid) or a derivative thereof with a di- or higher-hydric alcohol (polyhydric alcohol) or a derivative thereof.

The crystalline polyester resin can have any melting point. The melting point is preferably in the range of 55 to 90° C., more preferably 60 to 85° C. A crystalline polyester resin having a melting point within this range results in a toner having sufficient low-temperature fixing characteristics. The melting point of the crystalline polyester resin can be controlled by the resin composition. In this specification, the melting point of the resin measured according to the procedure in Examples is used.

The polyvalent carboxylic acid and the polyhydric alcohol forming the crystalline polyester resin preferably have 2 to 3 valences, more preferably 2 valences. A divalent polyvalent carboxylic acid and a dihydric polyhydric alcohol (i.e., the dicarboxylic acid component and the diol component) will now be described.

The dicarboxylic acid component is preferably an aliphatic dicarboxylic acid in combination with an aromatic dicarboxylic acid, when necessary. A linear aliphatic dicarboxylic acid is preferred. An advantage of the linear aliphatic dicarboxylic acid is the improved crystallinity of the crystalline polyester resin. These dicarboxylic acid components may be used alone or in combination of two or more kinds.

Examples of the aliphatic dicarboxylic acid include: oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid (dodecanedioic acid), 1,11-undecanedicarboxylic acid, 1,12-dodecanedicarboxylic acid (tetradecanedioic acid), 1,13-tridecanedicarboxylic acid, 1,14-tetradecanedicarboxylic acid, 1,16-hexadecanedicarboxylic acid, and 1,18-octadecanedicarboxylic acid.

Among these aliphatic dicarboxylic acids, preferred are aliphatic dicarboxylic acids having 6 to 14 carbon atoms, and more preferred are aliphatic dicarboxylic acids having 8 to 14 carbon atoms.

Examples of the aromatic dicarboxylic acid usable in combination with the aliphatic dicarboxylic acid include: phthalic acid, terephthalic acid, isophthalic acid, orthophthalic acid, t-butylisophthalic acid, 2,6-naphthalenedicarboxylic acid, and 4,4'-biphenyldicarboxylic acid. Among these aromatic dicarboxylic acids, preferred are terephthalic acid, isophthalic acid, and t-butylisophthalic acid in view of availability and ease of emulsification.

These dicarboxylic acids may be replaced with polyvalent carboxylic acids having three or more valences, such as trimellitic acid and pyromellitic acid, anhydrides of these carboxylic acids, or alkyl esters having 1 to 3 carbon atoms of the dicarboxylic acids described above.

In the dicarboxylic acid component that forms the crystalline polyester resin, the content of the aliphatic dicarboxylic acid is preferably at least 50 mol %, more preferably at least 70 mol %, still more preferably at least 80 mol %, most preferably 100 mol %. A dicarboxylic acid component containing at least 50 mol % of aliphatic dicarboxylic acid may sufficiently ensure high crystallinity of the polyester resin.

The diol component is preferably an aliphatic diol in combination with a diol other than an aliphatic diol, when necessary. A linear aliphatic diol is preferred. An advantage of the linear aliphatic diol is the improved crystallinity of the crystalline polyester resin. The diol components may be used alone or in combination of two or more kinds.

Examples of the aliphatic diol include: ethylene glycol, 1,2-propanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, 1,20-eicosanediol, and neopentyl glycol.

Among these aliphatic diols, the diol component is preferably aliphatic diols having 2 to 12 carbon atoms, more preferably 3 to 10 carbon atoms.

The diols that are usable in combination with the aliphatic diol are diols having a double bond or a sulfonic acid group. Specific examples of the diol having a double bond include: 1,4-butenediol, 2-butene-1,4-diol, 3-hexene-1,6-diol, and 4-octene-1,8-diol. Further, three- or higher-hydric alcohols may be used in combination with the aliphatic diol. Examples of the three- or higher-hydric alcohols include glycerol, pentaerythritol, trimethylolpropane, and sorbitol.

In the diol component that forms the crystalline polyester resin, the content of the aliphatic diol is preferably at least 50 mol %, more preferably at least 70 mol %, still more preferably at least 80 mol %, particularly preferably 100 mol %. A diol component containing 50 mol % or more of aliphatic diol may ensure the crystallinity of the crystalline polyester resin, resulting in a toner having excellent low-temperature fixing characteristics.

The crystalline polyester resin preferably has a weight average molecular weight (Mw) of 3,000 to 100,000, more preferably 4,000 to 50,000, still most preferably 5,000 to 20,000 from the viewpoint of ensuring the compatibility between sufficient low-temperature fixing characteristics and high long-term heat-resistant storage stability. The ratio of the diol component to the dicarboxylic acid component, i.e., the ratio [OH]/[COOH] of an equivalent of hydroxy groups [OH] in the diol component to an equivalent of carboxy groups [COOH] in the dicarboxylic acid component is preferably within the range of 1.5/1 to 1/1.5, more preferably 1.2/1 to 1/1.2.

The production method of the crystalline polyester resin is not particularly limited. It may be prepared by polycondensation (esterification) of the aforesaid dicarboxylic acid and dihydric alcohol in the presence of a known esterification catalyst.

Examples of the catalyst usable in preparation of the crystalline polyester resin include: compounds of alkali metals such as sodium and lithium; compounds containing Group II elements, such as magnesium and calcium; compounds of metals, such as aluminum, zinc, manganese, antimony, titanium, tin, zirconium, and germanium; phosphite compounds; phosphate compounds; and amine compounds. Specific examples of tin compounds include: dibutyltin oxide, and organic tin salts, such as tin octylate and tin dioctylate. Examples of titanium compounds include titanium alkoxides, such as tetra-n-butyl titanate, tetraisopropyl titanate, tetramethyl titanate, and tetrastearyl titanate; titanium acylates, such as polyhydroxytitanium stearate; and titanium chelates, such as titanium tetraacetylacetonate, titanium lactate, and titanium triethanolaminate. Examples of germanium compounds include germanium dioxide. Examples of aluminum compounds include aluminum oxides, such as aluminum polyhydroxide; aluminum alkoxides; and tributyl aluminate. These aluminum compounds may be used alone or in combination of two or more kinds.

The polymerization may be carried out at any temperature, preferably in the range of 150 to 250° C. Any polymerization time can be used. The preferred polymerization time is in the range of 0.5 to 15 hours. The pressure of the reaction system may be reduced during polymerization as needed.

The binder resin may contain any amount of crystalline resin (preferably, crystalline polyester resin). The content is preferably less than 50 mass %, more preferably 30 mass % or less, most preferably 10 mass % or less relative to the total amount of the binder resin. When the crystalline resin is a crystalline polyester resin, a content of less than 50 mass % may reduce the environmental dependency of the electrical charge attributed to the moisture absorption of the crystalline polyester resin. Any lower limit of the content may be used. In the binder resin containing a crystalline resin (preferably, crystalline polyester resin), the preferred content is 5 mass % or more. When the content of the crystalline resin is 5 mass % or more relative to the total amount of the binder resin, the resulting toner has high low-temperature fixing characteristics.

<Colorant>

Any colorant, such as carbon black, magnetic substances, dyes, and pigments, can be used.

Examples of usable carbon black include channel black, furnace black, acetylene black, thermal black, and lamp black.

Examples of the magnetic substances include ferromagnetic metals, such as iron, nickel, and cobalt; alloys containing these metals; and compounds of ferromagnetic metals, such as ferrite and magnetite.

Examples of the dyes include C.I. Solvent Reds 1, 49, 52, 58, 63, 111, and 122; C.I. Solvent Yellows 19, 44, 77, 79, 81, 82, 93, 98, 103, 104, 112, and 162; C.I. Solvent Blues 25, 36, 60, 70, 93, and 95; and mixtures thereof.

Examples of the pigments include C.I. Pigment Reds 5, 48:1, 48:3, 53:1, 57:1, 81:4, 122, 139, 144, 149, 166, 177, 178, and 222; C.I. Pigment Oranges 31 and 43; C.I. Pigment Yellows 14, 17, 74, 93, 94, 138, 155, 180, and 185; C.I. Pigment Green 7; C.I. Pigment Blues 15:3, 15:4, and 60; and mixtures thereof.

<Mold Release Agent>

The mold release agent may be a variety of known waxes.

Examples of the waxes include polyolefin waxes, such as polyethylene wax and polypropylene wax; branched hydrocarbon waxes, such as microcrystalline wax; long-chain hydrocarbon waxes, such as paraffin wax and SASOL wax; dialkyl ketone waxes, such as distearyl ketone; ester waxes, such as carnauba wax, montan wax, behenyl behenate, trimethylolpropane tribehenate, pentaerythritol tetrabehenate, pentaerythritol diacetate dibehenate, glycerol tribehenate, 1,18-octadecanediol distearate, tristearyl trimellitate, and distearyl maleate; and amide waxes, such as ethylenediaminebehenylamide and trimellitic tristearylamide.

The content of the mold release agent is preferably in the range of 0.1 to 30 mass parts, more preferably 1 to 10 mass parts relative to 100 mass parts of binder resin. These mold release agents can be used alone or in combination of two or more kinds. The preferred melting point of the mold release agent is in the range of 50 to 95° C. in view of the low-temperature fixing characteristics and releasing characteristics of the electrophotographic toner.

<Charge Controlling Agent>

A variety of known charge controlling agent particles that can be dispersed in an aqueous medium may be used.

Specific examples thereof include: nigrosine dyes, metal salts of naphthenic acid or higher fatty acids, alkoxylated amines, quaternary ammonium salts, azo metal complexes, and salicylic acid metal salts or metal complexes thereof.

<External Additive>

The toner particles according to the present invention contain an external additive on the surface of the toner mother particle.

The external additive according to the present invention contains inorganic particles. The aforesaid inorganic particles are surface-modified with silicone oil. A carbon content remained on the surface of the inorganic particles after surface-modified is in the range of 3.0 to 10.0 mass %, and a free carbon ratio is 70.0% or more.

(Inorganic Fine Particles)

Examples of the inorganic fine particles are: inorganic oxide fine particles such as silica fine particles, aluminum oxide fine particles (alumina fine particles), and titanium oxide fine particles; inorganic stearic acid compound fine particles such as aluminum stearate fine particles and zinc stearate fine particles; and inorganic titanium acid compound fine particles such as strontium titanate fine particles and zinc titanate fine particles. From the viewpoint of effectively obtaining the effect of the present invention, it is preferable to use silica fine particles or aluminum oxide fine particles as the inorganic fine particles.

It is preferable that the inorganic fine particles have a number average primary-particle diameter in the range of 25 to 100 nm from the viewpoint of effectively obtaining the effect of the present invention. When the inorganic fine particles have a number average primary-particle diameter of 25 nm or more, they easily contact with a carrier particle even when the surface of the toner mother particle has some irregularity. Consequently, the silicone oil will be easily transferred to the carrier particle to result in exhibiting a sufficient function of the silicone oil. When the inorganic fine particles have a number average primary-particle diameter of 100 nm or less, the amount of the inorganic fine particles existing on the surface of the toner mother particle may be easily maintained. Consequently, the silicone oil will be easily transferred to the carrier particle to result in exhibiting a sufficient function of the silicone oil.

(Surface Modification with Silicone Oil)

The inorganic particles used for the external additive according to the present invention are surface-modified with silicone oil. Known silicone oil may be used. Examples thereof include: dimethylsilicone oil, alkyl-modified silicone oil, amino-modified silicone oil, carboxyl-modified silicone oil, epoxy-modified silicone oil, fluorine-modified silicone oil, alcohol-modified silicone oil, polyether-modified silicone oil, methylphenyl silicone oil, methylhydrogen silicone oil, mercapto-modified silicone oil, higher fatty acid-modified silicone oil, phenol-modified silicone oil, methacrylic acid-modified silicone oil, polyether-modified silicone oil, and methylstyryl-modified silicone oil.

Among these silicone oils, preferred is dimethylsilicone oil in view of cost and ease of handling.

These silicone oils for surface modification may be used alone or in combination of two or more kinds.

(Carbon Content of External Additive Surface)

The external additive according to the present invention has a carbon content on the surface of the external additive after surface modification with silicone oil is in the range of 3.0 to 10.0 mass %. By making the carbon content to be 3.0 mass % or more, the effect caused by incorporation of the silicone oil may be easily obtained. By making the carbon content to be 10.0 mass % or less, excessive transfer amount of the silicone oil from the inorganic fine particle to the carrier particle may be prevented, and it may be prevented generation of the whitening in the lead portion.

(Free Carbon Ratio)

The external additive according to the present invention has a free carbon ratio on the surface of the external additive after surface modification with silicone oil is 70.0% or more. By making the free carbon ratio to be 70.0% or more, the silicone oil may be effectively transferred to the carrier particle, whereby the effect of the present invention may be effectively obtained.

(Measuring Method of Carbon Content and Free Carbon Ratio)

The carbon content was calculated by measuring the external additive after surface modification with silicone oil with a CHN element analyzer (CHN CORDER MT-5, made by Yanako Co., Ltd.). A quantitative carbon amount was obtained.

The measurement of a free carbon ratio was determined as described in the following. First, by using a Soxhlet extractor (made by BUCHI Co.), 0.7 g of the external additive in a powder state was put in a cylinder filter of 28 mm diameter. Hexane was used for an extraction solvent. Free silicone oil on the external additive in a powder state was removed under the condition of extraction time of 60 minutes and rinse time of 30 minutes. The external additive after removing the silicone oil was subjected to the measurement by the CHN element analyzer (CHN CORDER MT-5, made by Yanako Co., Ltd.). A quantitative carbon amount was measured, and a free carbon ratio was obtained with the following expression.

$$\text{Free carbon ratio}=\{(C0-C1)/C0\}\times 100$$

C0: Carbon content on the surface of the external additive before the extraction operation of the silicone oil C1: Carbon content on the surface of the external additive after the extraction operation of the silicone oil (Kinetic Viscosity of Silicone Oil)

It is preferable that the silicone oil according to the present invention has a kinetic viscosity in the range of 50 to 500 $mm^2/s$ at 25° C. from the viewpoint of effectively obtaining the effect of the present invention. When the kinetic viscosity at 25° C. is 50 $mm^2/s$ or more, the silicone oil will be easily transferred to the carrier particles to result in exhibiting a sufficient function of the silicone oil. When the kinetic viscosity at 25° C. is 500 $mm^2/s$ or less, the silicone oil transferred to the carrier particles will remain on the carrier particles to result in exhibiting a sufficient function of the silicone oil. The kinetic viscosity at 25° C. may be measured with a measuring method according to JIS K2283.

(Other External Additives)

The toner particles according to the present invention may further contain other known external additives. Examples of the other known external additives include: inorganic oxide fine particles such as silica fine particles, aluminum oxide fine particles and titanium oxide fine particles; and inorganic titanic acid compound fine particles such as strontium titanate and zinc titanate. These inorganic fine particles may be subjected to a gloss and hydrophobic treatment with a silane coupling agent, a titanium coupling agent, higher fatty acid, or silicone oil to improve the heat-resistant storage characteristics and the environmental stability of the toner.

Further, organic fine particles may be used as other external additive. The organic fine particles may be spherical organic particles having a number average primary-particle diameter of about 10 to 2000 nm, for example. Specifically, organic fine particles composed of a homopolymer of styrene or methyl methacrylate or a copolymer thereof may be used.

Further, a lubricant may be used as other external additive. The lubricant is used to further improve the cleaning characteristics and transfer characteristics of the toner. The lubricant may be a metal salt of higher fatty acid, for example. Specific examples of the metal salts of higher fatty acids include: salts of stearic acid with zinc, aluminum, copper, magnesium, and calcium; salts of oleic acid with zinc, manganese, iron, copper, and magnesium; salts of palmitic acid with zinc, copper, magnesium, and calcium; salts of linoleic acid with zinc and calcium; and salts of ricinoleic acid with zinc and calcium.

<Volume-Based Average Particle Diameter of Toner Particles>

It is preferable that the toner particles after addition of the external additive have a volume average particle diameter of 4 to 10 μm. When the volume-based average particle diameter is within this range, the mobility of the toner particles will be improved, whereby it is possible to suppress the reduction in the rise of the charge amount of the toner particles and the deterioration of the image quality. The volume average particle diameter of the toner particles is more preferably in the range of 5 to 8 μm, and still more preferably in the range of 5.0 to 7.5 μm.

The volume average particle diameter of the toner particles is a value obtained as a volume-based median diameter ($D_{50}$) by the following method.

The volume-based median diameter ($D_{50}$) of the toner particles may be measured and calculated by using measuring equipment composed of "MULTISIZER 3" (Beckman Coulter Inc.) and a computer system installed with a data processing software.

Specifically, a predetermined amount (0.02 g) of a measuring sample (toner particles) is added to a predetermined amount (20 mL) of surfactant solution (for dispersing the toner particles, e.g. a surfactant solution prepared by eluting a neutral detergent containing a surfactant component with purified water by 10 times) and is allowed to be uniform, and then the solution is subjected to ultrasonic dispersion.

The toner particle dispersion liquid thus prepared is added to "ISOTON II" (Beckman Coulter Inc.) in a beaker placed in sample stand by a pipet until the concentration displayed on the measuring equipment reaches 5 to 10%. The measuring particle count of the measuring equipment is set to be 25,000.

The aperture size of the measuring equipment is set to be 100 μm. The measuring range, which is from 1 to 30 μm, is divided into 256 sections to calculate the respective frequencies. The particle diameter where the accumulated volume counted from the largest size reaches 50% is determined as the volume-based median diameter ($D_{50}$).

The volume average particle diameter of the toner particles may be controlled by changing the concentration of the aggregating agent, the added amount of organic solvent, or fusing time used in the production.

<Average Circularity of Toner Particles>

It is preferable that the toner particles in the toner of the present invention have an average circularity of 0.98 or less, more preferably 0.97 or less, and still more preferably in the range of 0.93 to 0.97. When the average circularity is within this range, the toner particles are more easily charged.

The average circularity of the toner particles is measured with a flow-type particle image analyzer "FPIA-3000" (made by Sysmex Corporation), for example. Specifically, it may be measured by the following method.

(Measuring Method)

Specifically, a measuring sample (toner particles) is wetted in an aqueous surfactant solution, and is ultrasonically dispersed for one minute. After making the dispersion, the average circularity is measured with the analyzer "FPIA-3000" in a high power field (HPF) mode at an appropriate density (the number of particles to be detected at an HPF: 3000 to 10000 particles). This range will provide reproducibility in the measurement. The circularity is calculated from the following expression:

Circularity of toner particle=(Perimeter of a circle having a projected area identical to that of the projected image of a particle)/(Perimeter of the projected image of the particle)

The average circularity indicates the arithmetic average value obtained by dividing the sum of circularities of particles by the number of particles.

The average circularity of the toner particles may be adjusted by controlling the temperature or time of the ripening treatment in the above-described production method.

<Production Method of Toner>

The production method of toner according to the present invention is not particularly limited. Any known methods may be used. Examples of the method include: a kneading pulverization method, a suspension polymerization, an emulsion aggregation method, a dissolution suspension method, a polyester extension method, and a dispersion polymerization method. Among these processes, preferred is emulsion aggregation method in view of the uniformity of the particle diameter and control of the shape of the toner.

In the emulsion aggregation method, toner particles are prepared as follows. A dispersion liquid of particles of a binder resin dispersed in a surfactant containing a dispersion stabilizer (hereinafter, also referred to as "binder resin particles") is mixed with a dispersion liquid of particles of a colorant (hereinafter, also referred to as "colorant particles") when necessary, and these particles are aggregated until the toner particles grow to a desired diameter. The binder resin particles are further fused to control the shapes of the toner particles. In this specification, the binder resin particles may optionally contain a mold release agent and a charge controlling agent.

In a preferred embodiment in preparation of the toner according to the present invention, toner particles having a core-shell structure are prepared by an emulsion aggregation method having the steps as indicated below.

(1) a step of preparing a dispersion liquid of colorant particles dispersed in an aqueous medium, (2) a step of dispersing binder resin particles containing internal additives when necessary in aqueous media to prepare a dispersion liquid of resin particles (a dispersion liquid of resin particles for a core and a dispersion liquid of resin particles for a shell layer), (3) a step (aggregation and fusion step) of mixing the dispersion liquid of colorant particles with the dispersion liquid of resin particles for a core to yield a resin particle dispersion liquid for aggregation, and aggregating and fusing colorant particles and binder resin particles in the presence of an aggregating agent to form aggregated particles as core material particles, (4) a step (aggregation and fusion step) of adding the dispersion liquid of resin particles for a shell layer to the dispersion liquid of resin particles for a core, and aggregating and fusing the particles for a shell layer onto the surfaces of the core material particles to form toner mother particles having a core-shell structure, (5) a step (washing step) of filtering the toner mother particles from the dispersion liquid of the toner mother particles (toner mother particles dispersion liquid) to remove the surfactant.

(6) a step (drying step) of drying the toner mother particles, and (7) a step (external additive treating step) of adding an external additive to the toner mother particles.

The toner particles having a core-shell structure may be prepared as follows. First, binder resin particles for core material particles and colorant particles are aggregated and fused into core material particles. Then, binder resin particles for a shell layer are added to the dispersion liquid of core material particles, and the binder resin particles for a shell layer are aggregated and fused onto the surfaces of the core material particles to form a shell layer on the surfaces of the core material particles.

However, the core-shell structure is not essential to the present invention. The toner particles having a mono layer formed without adding the dispersion liquid of resin particles for a shell layer in the step (4) may be produced in the same way.

<External Additive Treating Step>

The external additive treating step (7) will be described. An external additive may be mixed with the toner mother particles using a mechanical mixer. The mechanical mixer used may be a Henschel mixer, a Nauta Mixer, or a turbular mixer. Among these mixers, a Henschel mixer, which can impart shear force to the particles, may be used to mix the materials for a longer time or with a stirring blade at a higher circumferential speed of rotation. When several kinds of external additives are used, all of the external additives may be mixed with the toner particles in one batch, or several aliquots of the external additives may be mixed with the toner particles.

In the mixing of the external additive, the degree of crush or adhesive strength of the external additive may be controlled with the mechanical mixer through control of the mixing strength or circumferential speed of the stirring blade, the mixing time, or the mixing temperature.

Although the embodiments of the present invention have been described and illustrated in detail, the disclosed embodiments are made for purpose of illustration and example only and not limitation. The scope of the present invention should be interpreted by terms of the appended claims.

EXAMPLES

Hereinafter, the present invention will be specifically described with reference to examples, but the present invention is not limited thereto.

<Preparation of Dispersion Liquid of Colorant Particles [Bk]>

Sodium n-dodecylsulfate (90 mass parts) was dissolved in deionized water (1600 mass parts) with stirring. The solution was gradually added to carbon black "MOGUL L" (made by Cabot Corporation, pH: 2, room temperature 25° C.) (420 mass parts) with stirring, and the mixture was dispersed with a stirrer "Cleamix" (made by M Technique Co., Ltd.) to prepare a dispersion liquid of Colorant particles [Bk] containing the carbon black particles. The diameters of Colorant particles [Bk] in the dispersion liquid were measured with a microtrack particle diameter distribution analyzer "UPA- 150" (made by NIKKISO CO., LTD.). Colorant particles [Bk] had a volume-based median diameter of 85 nm.

<Preparation of Crystalline Polyester Resin [1]>

A mixed solution of 1,9-nonanediol (300 g), dodecanedioic acid (250 g), a catalyst $Ti(OBu)_4$ (0.014 mass % relative to carboxylic acid monomer) was placed in a three-necked flask, and the container was depressurized. The three-necked flask was purged with nitrogen gas to provide an inert atmosphere in the flask. The mixed solution was refluxed at 180° C. for six hours while being mechanically stirred. Subsequently, the unreacted monomer component was removed through distillation under reduced pressure. The product was gradually heated to 220° C., and was stirred for 12 hours. When the product became viscous, the product was cooled to yield a crystalline polyester resin [1]. The crystalline polyester resin [1] had a weight average molecular weight (Mw) of 19500 and a melting point of 75° C. The weight average molecular weight (Mw) and the melting point were measured as follows.

(Measurement of Weight Average Molecular Weight)

The weight average molecular weight was determined with a gel permeation chromatograph "HLC-8220" (made by Tosoh Corporation) provided with three columns of "TSKguard column+TSKgel SuperHZM-M" (made by Tosoh Corporation). While the column temperature was kept at 40° C., a carrier solvent tetrahydrofuran (THF) was fed through the columns at a flow rate of 0.2 mL/min. A sample solution (10 μL) was injected into the apparatus to measure the refractive index with a refractive index detector (RI detector). The molecular weight distribution of the sample was determined through calculation using a calibration curve determined with monodispersed standard polystyrene beads.

(Measurement of Melting Point of Crystalline Resin)

The melting point of the crystalline resin was determined with a differential scanning calorimeter "Diamond DSC" (made by PerkinElmer Inc.) as follows: A sample (3.0 mg) was sealed in an aluminum pan, and was placed on a sample holder. An empty aluminum pan was placed on a reference holder. The sample was sequentially subjected to a first heating cycle to heat the sample from 0° C. to 200° C. at a heating rate of 10° C./min, a cooling cycle to cool the sample from 200° C. to 0° C. at a cooling rate of 10° C./min, and a second heating cycle to heat the sample from 0° C. to 200° C. at a heating rate of 10° C./min to produce a DSC curve. Based on the DSC curve, the endothermic peak temperature derived from the crystalline polyester in the first heating cycle was defined as the melting point of the crystalline polyester.

<Preparation of Dispersion Liquid of Resin Particles [L3] for Core>

A dispersion liquid of resin particles (Resin particles (L3) for a core) containing binder resin particles dispersed inside the resin particles was prepared through the following first to third polymerization stages.

(1) Preparation of Dispersion Liquid of Resin Particles [L1] (First Polymerization)

Sodium polyoxyethylene (2) dodecyl ether sulfate (4 g) and deionized water (3000 g) were placed in a 5-L reaction container equipped with a stirrer, a temperature sensor, a cooling tube, and a nitrogen inlet, and the mixed solution was heated to 80° C. while being stirred at a stirring rate of 230 rpm under a nitrogen stream. After the heating, a solution of potassium persulfate (10 g) in deionized water (200 g) was added to the mixed solution, and the solution was heated to 75° C. A solution of mixed monomers having the following composition was added dropwise to the solution over one hour. The mixed solution was then heated at 75° C. for two hours with stirring to polymerize the monomers. A dispersion liquid of Resin particles [L1] was thereby prepared.

| | |
|---|---|
| Styrene: | 568 g |
| n-Butyl acrylate: | 164 g |
| Methacrylic acid: | 68 g |

(2) Preparation of Dispersion Liquid of Resin Particles [L2] (Second Polymerization)

A solution of sodium polyoxyethylene(2) dodecyl ether sulfate (2 g) in deionized water (3000 g) was placed in a 5-L reaction container equipped with a stirrer, a temperature sensor, a cooling tube, and a nitrogen inlet, and the mixed solution was heated to 80° C.

The monomers in the following composition were dissolved at 80° C. to prepare a monomer solution:

| | |
|---|---|
| Resin particles [L1]: | 42 g (solid content) |
| Behenyl behenate: | 70 g |
| Crystalline polyester resin [1]: | 70 g |
| Styrene: | 195 g |
| n-Butyl acrylate: | 91 g |
| Methacrylic acid: | 20 g |
| n-Octylmercaptan: | 3 g |

The monomer solution was then added to the mixed solution, and was dispersed for one hour with a mechanical dispersing machine "CLEARMIX" (made by M Technique Co., Ltd.) having a circulation path to prepare a dispersion liquid containing emulsified particles (oil droplets).

In the next step, potassium persulfate (5 g) was dissolved in deionized water (100 g) to prepare an initiator solution, and the initiator solution was added to the dispersion liquid. The obtained dispersion liquid was heated at 80° C. over one hour with stirring to polymerize the monomers. A dispersion liquid of Resin particles [L2] was thereby prepared.

(3) Preparation of Dispersion Liquid of Resin Particles [L3] for Core (Third Polymerization)

A solution of potassium persulfate (10 g) in deionized water (200 g) was further added to the dispersion liquid of Resin particles [L2]. The dispersion liquid was kept at 80° C., and a solution of mixed monomers having the following composition was added dropwise to the dispersion liquid over one hour. After the addition, the dispersion liquid was heated over two hours with stirring to polymerize the monomers, and was cooled to 28° C. to prepare a dispersion liquid of Resin particles [L3] for a core.

| | |
|---|---|
| Styrene: | 298 g |
| n-Butyl acrylate: | 137 g |
| n-Stearyl acrylate: | 50 g |
| Methacrylic acid: | 64 g |
| n-Octylmercaptan: | 6 g |

<Preparation of Dispersion Liquid of Resin Particles [S1] for Shell>

A surfactant solution of polyoxyethylene dodecyl ether sodium sulfate (2.0 g) in deionized water (3000 g) was placed in a reaction container equipped with a stirrer, a temperature sensor, a cooling tube, and a nitrogen inlet. The solution was heated to 80° C. while being stirred at a stirring rate of 230 rpm under a nitrogen stream. An initiator solution of potassium persulfate (10 g) in deionized water (200 g)

was mixed with the solution. A mixed monomer solution having the following composition was added dropwise to the mixed solution over three hours. The mixed solution was then heated at 80° C. over one hour with stirring to polymerize the monomers. A dispersion liquid of Resin particles [S1] for a shell was thereby prepared.

| | |
|---|---|
| Styrene: | 564 g |
| n-Butyl acrylate: | 140 g |
| Methacrylic acid: | 96 g |
| n-Octylmercaptan: | 12 g |

<Preparation of Core-Shell Particles [1] (Aggregation and Fusion Step)>

The dispersion liquid of Resin particles [L3] for a core (solid content: 360 g), deionized water (1100 g), and the dispersion liquid (40 g) of Colorant particles [Bk] were placed in a 5-L reaction container equipped with a stirrer, a temperature sensor, a cooling tube, and a nitrogen inlet. The temperature of the dispersion was adjusted to 30° C., and an aqueous solution of 5 N sodium hydroxide was added to the dispersion liquid to adjust the pH of the dispersion liquid to 10.

In the next step, an aqueous solution of magnesium chloride (60 g) in deionized water (60 g) was added dropwise to the dispersion liquid at 30° C. over ten minutes under stirring. After addition, the dispersion liquid was kept at 30° C. for three minutes, and then heating was started. The dispersion liquid was heated to 85° C. over 60 minutes. A particle growth reaction was continued while the temperature of the dispersion was kept at 85° C. A dispersion liquid of Core particles [1] was thereby prepared. Resin particles [S1] for a shell (solid content: 80 g) were added to the dispersion liquid, and were continuously stirred at 80° C. over one hour to fuse Resin particles [S1] for a shell onto the surfaces of Core particles [1]. A shell layer was thereby formed to prepare Resin particles [1].

An aqueous solution of sodium chloride (150 g) in deionized water (600 g) was added to the dispersion liquid. The dispersion liquid was aged at a solution temperature of 80° C. When the average circularity of Resin particles [1] reached 0.960, the dispersion liquid was cooled to 30° C. to prepare Core-shell particles [1]. Core-shell particles [1] after cooling had a volume-based median diameter of 5.5 μm.

(Number-Based Median Diameter of Core-Shell Particles)

The number-based median diameter of the core-shell particles is a median diameter in a number-based particle diameter distribution. It is measured and calculated by using measuring equipment composed of a "MULTISIZER 3" (Beckman Coulter Inc.) and a computer system installed with data processing software connected thereto.

Specifically, a predetermined amount (0.02 g) of a measuring sample (core-shell particles) is added to a predetermined amount (20 mL) of surfactant solution (for dispersing the core-shell particles, e.g. a surfactant solution prepared by eluting a neutral detergent containing a surfactant component with purified water by 10 times) and is allowed to be uniform, and then the solution is subjected to ultrasonic dispersion for 1 minute. The core-shell particle dispersion thus prepared is added to "ISOTON II" (Beckman Coulter Inc.) in a beaker placed in sample stand by a pipet until the concentration displayed on the measuring equipment reaches 5 to 10%. Within making in this concentration range, reproducible measurement values may be obtained. The measuring particle count and the aperture size of the measuring equipment "MULTISIZER 3" (Beckman Coulter Inc.) are set to 25,000 and 100 μm respectively. The measuring range, which is from 1 to 30 μm, is divided into 256 sections to calculate the respective frequencies. The particle diameter where the accumulated number counted from the largest size reaches 50% is determined as the number-based median diameter.

<Average Circularity of Core-Shell Particles>

The average circularity of the core-shell particles is measured with a flow-type particle image analyzer "FPIA-3000" (made by Sysmex Corporation), for example. Specifically, it may be measured by the following method.

(Measuring Method)

Specifically, a measuring sample (core-shell particles) is wetted in an aqueous surfactant solution, and is ultrasonically dispersed for one minute. After obtaining the dispersion liquid, the average circularity is measured with the analyzer "FPIA-3000" in a high power field (HPF) mode at an appropriate density (the number of particles to be detected at an HPF: 3000 to 10000 particles). This range will provide reproducibility in the measurement. The circularity is calculated from the following expression:

Circularity of core-shell particle=(Perimeter of a circle having a projected area identical to that of the projected image of a particle)/(Perimeter of the projected image of the particle)

The average circularity indicates the arithmetic average value obtained by dividing the sum of circularities of particles by the number of particles.

<Preparation of Toner Mother Particles [1] (Washing and Drying Step)>

The dispersion liquid of Core-shell particles [1] prepared through the aggregation and fusion steps was subjected to solid liquid separation with a centrifuge to yield wet cake of Core-shell particles [1]. The wet cake was centrifugally washed with deionized water at 35° C. until the electric conductivity of the filtrate reached 5 μS/cm. The wet cake was then placed in a "flash jet dryer" (made by Seishin Enterprise Co., Ltd.), and was dried until the moisture content reached 0.8 mass %. Toner mother particles [1] was thereby prepared.

<Preparation of Inorganic Particles [1]>

To 100 mass parts of silica particles having a number average primary-particle diameter of 30 nm and produced with a gas phase method was sprayed a solution of 8 mass parts of silicone oil having a kinetic viscosity of 100 $mm^2/s$ at 25° C. (KF-96-100 cs, made by Shin-Etsu Chemical Co. Ltd.) diluted with 50 mass parts of hexane while stirring under a nitrogen gas atmosphere. This reaction mixture was dried with stirring under a nitrogen gas atmosphere at 240° C. for 60 minutes. Then, it was cooled to obtain Inorganic particles [1]. A carbon content after subjected to a surface treatment was 2.5 mass %, and a free carbon ratio was 76%.

(Measuring of Carbon Content and Free Carbon Ratio)

The carbon content was calculated by measuring the external additive after surface modification with silicone oil with a CHN element analyzer (CHN CORDER MT-5, made by Yanako Co., Ltd.). A quantitative carbon amount was obtained.

The measurement of a free carbon ratio was determined as described in the following. First, by using a Soxhlet extractor (made by BUCHI Co.), 0.7 g of the external additive in a powder state was put in a cylinder filter of 28 mm diameter. Hexane was used for an extraction solvent. Free silicone oil on the external additive in a powder state was removed under the condition of extraction time of 60 minutes and rinse time of 30 minutes. The external additive after removing the silicone oil was subjected to the measurement by the CHN element analyzer (CHN CORDER MT-5, made by Yanako Co., Ltd.). A quantitative carbon amount was measured, and a free carbon ratio was obtained with the following expression.

$$\text{Free carbon ratio}=\{(C0-C1)/C0\}\times 100$$

C0: Carbon content on the surface of the external additive before the extraction operation of the silicone oil C1: Carbon content on the surface of the external additive after the extraction operation of the silicone oil <Preparation of Inorganic Particles [2] to [20]>

Inorganic particles [2] to [20] were prepared in the same manner as preparation of the Inorganic particles [1] except for the change as indicated in Table 1. A kind of inorganic particles, a number average primary-particle diameter, a kind, kinetic viscosity, added amount of silicon oil, a drying temperature during stirring under a nitrogen gas stream were change.

In Table I, the used compounds A1 to A6 were silicone oil as indicated in the following.

A1: KF-96-100cs, made by Shin-Etsu Chemical Co. Ltd.

A2: KF-96-10cs, made by Shin-Etsu Chemical Co. Ltd.

A3: KF-96-50cs, made by Shin-Etsu Chemical Co. Ltd.

A4: KF-96-300cs, made by Shin-Etsu Chemical Co. Ltd.

A5: KF-96-500cs, made by Shin-Etsu Chemical Co. Ltd.

A6: KF-96-500cs and KF-96-1000cs, made by Shin-Etsu Chemical Co. Ltd.

A6 was a mixture of the above-described silicone oils and adjusted a kinetic viscosity to be 650 $mm^2/s$.

TABLE I

| | 無機微粒子 | | Silicone oil | | | | | | |
|---|---|---|---|---|---|---|---|---|---|
| Inorganic particles No. | Kind | Number average primary-particle diameter (nm) | Kind | Kinetic viscosity ($mm^2/s$) | Added amount (mass parts) | Drying temperature (° C.) | Carbon content (mass %) | Free carbon amount (mass %) | Free carbon ratio (%) |
| 1 | Silica | 30 | A 1 | 100 | 8 | 240 | 2.5 | 1.9 | 76.0 |
| 2 | Silica | 30 | A 1 | 100 | 11 | 250 | 3.0 | 2.2 | 73.3 |
| 3 | Silica | 30 | A 1 | 100 | 22 | 280 | 6.0 | 4.5 | 75.0 |
| 4 | Silica | 30 | A 1 | 100 | 29 | 310 | 10.0 | 7.4 | 74.0 |
| 5 | Silica | 30 | A 1 | 100 | 30 | 315 | 10.5 | 7.7 | 73.3 |
| 6 | Silica | 30 | A 1 | 100 | 22 | 360 | 6.1 | 3.7 | 60.7 |
| 7 | Silica | 30 | A 1 | 100 | 22 | 340 | 5.9 | 4.1 | 70.0 |
| 8 | Silica | 30 | A 1 | 100 | 22 | 240 | 5.8 | 4.9 | 84.5 |
| 9 | Silica | 30 | A 1 | 100 | 22 | 210 | 5.8 | 5.5 | 94.8 |
| 10 | Silica | 12 | A 1 | 100 | 35 | 300 | 5.7 | 4.3 | 75.4 |
| 11 | Silica | 25 | A 1 | 100 | 32 | 300 | 5.7 | 4.3 | 75.4 |
| 12 | Silica | 80 | A 1 | 100 | 22 | 300 | 5.7 | 4.4 | 77.2 |
| 13 | Silica | 100 | A 1 | 100 | 18 | 300 | 5.8 | 4.6 | 79.3 |
| 14 | Silica | 120 | A 1 | 100 | 16 | 300 | 5.8 | 4.5 | 77.6 |
| 15 | Silica | 30 | A 2 | 10 | 35 | 280 | 5.9 | 4.4 | 74.6 |
| 16 | Silica | 30 | A 3 | 50 | 28 | 280 | 6.2 | 4.6 | 74.2 |
| 17 | Silica | 30 | A 4 | 300 | 16 | 280 | 6.1 | 4.4 | 72.1 |
| 18 | Silica | 30 | A 5 | 500 | 13 | 280 | 5.8 | 4.4 | 75.9 |
| 19 | Silica | 30 | A 6 | 650 | 10 | 280 | 5.7 | 4.2 | 73.7 |
| 20 | Aluminum oxide | 30 | A 1 | 100 | 15 | 280 | 5.2 | 4.0 | 76.9 |

<Preparation of Toner [1] (External Additive Treating Step)>

The following external additive particles were added to Toner mother particles [1] in a Henschel mixer "FM20C/I" (made by NIPPON COKE & ENGINEERING CO., LTD.), and were stirred for 15 minutes with a blade at a rotational frequency, i.e., a circumferential rate of 40 m/s at the distal end. Toner [1] was thereby prepared.

Inorganic particles [1]: 1.0 mass part

Hydrophobic titania: 0.4 mass parts

The mixing temperature for the external additive particles and Toner mother particles [1] was set to be 40±1° C. The internal temperature of the Henschel mixer was controlled with cooling water at a flow rate of 5 L/min through an external bath of the Henschel mixer if the temperature reached 41° C., and with cooling water at a flow rate of 1 L/min through the external bath if the temperature reached 39° C.

<Preparation of Toners [2] to [20]>

Toners [2] to [20] were prepared in the same manner as preparation of the Toner [1] except that the Inorganic particles [1] were respectively changed with the Inorganic particles [2] to [20].

<Preparation of Core Material Particles [1]>

Each raw material was blended in an appropriate amount so as to be 19.0 mol % in terms of MnO, 2.8 mol % in terms of MgO, 1.5 mol % in terms of SrO and 75.0 mol % in terms of $Fe_2O_3$. Next, water was added to these materials, the mixture was pulverized with a wet ball mill for 10 hours, it was mixed, dried and kept at 950° C. for 4 hours. Next, the slurry pulverized by a wet ball mill for 24 hours was granulated and dried, 50% of the volume was added to a sintering furnace containing a stirring device, and the slurry was circulated and retained at a peripheral speed of 10 m/s at 1300° C. for 4 hours. Then, it was pulverized, and the particle diameter was adjusted to be diameter of 35 mm. Whereby Core material particles [1] were obtained. The resistance thereof was $5.5\times10^6$ Ω·cm.

<Preparation of Core Material Particles [2]>

In the preparation method the Core material particles [1], after retained the substance at a peripheral speed of 10 m/s at 1300° C. for 4 hour, the substance was pulverize, then heated in a rotary kiln under the conditions of 15 rpm, at 700° C. for 0.3 hours. Then, the particle diameter was adjusted to a particle diameter of 35 mm to obtain Core material particles [2]. The resistance thereof was $8.0\times10^6$ Ω·cm.

<Preparation of Core Material Particles [3] to [5]>

Core material particles [3] to [5] were prepared in the same manner as preparation of the Core material particles [2] except that the treating time using a rotary kiln under the conditions of 15 rpm, at 700° C. was respectively changed as indicated in Table II.

<Preparation of Carrier Particles [1]>

100 mass parts of the prepared Core material particles [1] and 2.9 mass parts of the resin particles for covering layer (co-polymer resin particles of cyclohexyl methacrylate/methyl methacrylate (50/50), a content of cyclohexyl methacrylate being 50 mass % in the covering layer, and cyclohexyl methacrylate is a alicyclic methacrylic acid ester monomer) were charged into a high-speed mixer with stirring blades. The mixture was stirred and mixed at a wind speed of 10 m/s at 25° C. for 45 minutes. A resin covering layer was formed on the surface of the core material particles by the action of a mechanical impact force. Then, it was cooled by lowering the wind speed to 2 m/s. Thus, Carrier particles [1] coated with a resin were prepared. The resistance thereof was $8.5\times10^{9}$ Ω·cm.

<Preparation of Carrier Particles [2] to [16]>

Carrier particles [2] to [16] were prepared in the same manner as preparation of the Carrier particles [1] except that the core material particles, amount of resin, and kind of resin were changed as indicated in Table II.

TABLE II

| Carrier particles No. | Core material particles No. | Treating time (hours) | Resistance (Ω · cm) | Covering layer *1 (mass %) | *2 (mass %) | *3 (mass %) | Resistance of Carrier particles (Ω · cm) |
|---|---|---|---|---|---|---|---|
| 1 | 1 | 0 | $5.5 \times 10^{6}$ | 50 | 2.9 | — | $8.5 \times 10^{9}$ |
| 2 | 2 | 0.3 | $8.0 \times 10^{6}$ | 50 | 2.8 | — | $8.2 \times 10^{9}$ |
| 3 | 3 | 1.0 | $4.0 \times 10^{7}$ | 50 | 2.8 | — | $9.0 \times 10^{9}$ |
| 4 | 4 | 1.7 | $3.0 \times 10^{8}$ | 50 | 2.8 | — | $1.1 \times 10^{10}$ |
| 5 | 5 | 2.0 | $4.8 \times 10^{8}$ | 50 | 2.7 | — | $1.0 \times 10^{10}$ |
| 6 | 3 | 1.0 | $4.0 \times 10^{7}$ | 50 | 1.85 | — | $9.0 \times 10^{8}$ |
| 7 | 3 | 1.0 | $4.0 \times 10^{7}$ | 50 | 1.9 | — | $1.0 \times 10^{9}$ |
| 8 | 3 | 1.0 | $4.0 \times 10^{7}$ | 50 | 2.5 | — | $5.0 \times 10^{9}$ |
| 9 | 3 | 1.0 | $4.0 \times 10^{7}$ | 50 | 3.3 | — | $2.0 \times 10^{10}$ |
| 10 | 3 | 1.0 | $4.0 \times 10^{7}$ | 50 | 3.9 | — | $5.0 \times 10^{10}$ |
| 11 | 3 | 1.0 | $4.0 \times 10^{7}$ | 50 | 4.0 | — | $6.0 \times 10^{10}$ |
| 12 | 3 | 1.0 | $4.0 \times 10^{7}$ | 85 | 2.8 | — | $9.7 \times 10^{9}$ |
| 13 | 3 | 1.0 | $4.0 \times 10^{7}$ | 75 | 2.8 | — | $9.4 \times 10^{9}$ |
| 14 | 3 | 1.0 | $4.0 \times 10^{7}$ | 25 | 2.8 | — | $8.5 \times 10^{9}$ |
| 15 | 3 | 1.0 | $4.0 \times 10^{7}$ | 10 | 2.8 | — | $8.1 \times 10^{9}$ |
| 16 | 3 | 1.0 | $4.0 \times 10^{7}$ | 0 | 2.8 | — | $7.8 \times 10^{9}$ |
| 17 | 3 | 1.0 | $4.0 \times 10^{7}$ | 50 | 2.9 | 0.29 | $4.7 \times 10^{9}$ |

*1: Content of alicyclic methacrylic acid ester monomer with respect to the covering layer
*2: Added amount of resin particles for a covering layer
*3: Added amount of carbon black (Number average primary-particle diameter: 30 nm)

<Preparation of Carrier Particles [17]>

Carrier particles [17] were prepared in the same manner as preparation of the Carrier particles [1] except that 0.29 mass parts of carbon black (having a number average primary-particle diameter: 30 nm) were added with the co-polymer resin particles. The resistance thereof was $4.7\times10^{9}$ Ω·cm.

<Preparation of Developer [1]>

Toner particles [1] and Carrier particles [1] were mixed with a V-type mixer for 30 minutes such that the resulting two-component developer contained 6 mass % of toner particles (toner content). Two-component Developer [1] was thereby prepared.

<Preparation of Developers [2] to [37]>

Developers [2] to [37] were prepared in the same manner as preparation of the Developer [1] except that the combination of the toner and the carrier particles was changed as indicated in Table III.

TABLE III

| Developer No. | Toner No./ Inorganic particles No. | Carrier particles No. | Evaluation: Lead portion whitening | Development leakage (V) | Remarks |
|---|---|---|---|---|---|
| 1 | 2 | 3 | ○ | 200 | Present invention |
| 2 | 3 | 3 | ○ | 300 | Present invention |
| 3 | 4 | 3 | Δ | 400 | Present invention |
| 4 | 7 | 3 | ○ | 250 | Present invention |
| 5 | 8 | 3 | ○ | 350 | Present invention |
| 6 | 9 | 3 | Δ | 400 | Present invention |
| 7 | 10 | 3 | ○ | 250 | Present invention |

TABLE III-continued

| Developer No. | Toner No./ Inorganic particles No. | Carrier particles No. | Evaluation: Lead portion whitening | Evaluation: Development leakage (V) | Remarks |
|---|---|---|---|---|---|
| 8 | 11 | 3 | ○ | 300 | Present invention |
| 9 | 12 | 3 | ○ | 300 | Present invention |
| 10 | 13 | 3 | ○ | 300 | Present invention |
| 11 | 14 | 3 | ○ | 250 | Present invention |
| 12 | 15 | 3 | ○ | 200 | Present invention |
| 13 | 16 | 3 | ○ | 250 | Present invention |
| 14 | 17 | 3 | ○ | 300 | Present invention |
| 15 | 18 | 3 | ○ | 250 | Present invention |
| 16 | 19 | 3 | ○ | 200 | Present invention |
| 17 | 20 | 3 | ○ | 300 | Present invention |
| 18 | 3 | 1 | ○ | 200 | Present invention |
| 19 | 3 | 2 | ○ | 250 | Present invention |
| 20 | 3 | 4 | ○ | 400 | Present invention |
| 21 | 3 | 5 | Δ | 450 | Present invention |
| 22 | 3 | 7 | ◎ | 200 | Present invention |
| 23 | 3 | 8 | ○ | 250 | Present invention |
| 24 | 3 | 9 | Δ | 350 | Present invention |
| 25 | 3 | 10 | Δ | 400 | Present invention |
| 26 | 3 | 12 | ○ | 200 | Present invention |
| 27 | 3 | 13 | ○ | 250 | Present invention |
| 28 | 3 | 14 | ○ | 250 | Present invention |
| 29 | 3 | 15 | ○ | 200 | Present invention |
| 30 | 3 | 16 | ○ | 150 | Present invention |
| 31 | 3 | 17 | ○ | 200 | Present invention |
| 32 | 1 | 3 | ○ | 150 | Comparative Example |
| 33 | 5 | 3 | X | 500 | Comparative Example |
| 34 | 6 | 3 | ○ | 150 | Comparative Example |
| 35 | 3 | 6 | ◎ | 150 | Comparative Example |
| 36 | 3 | 11 | X | 450 | Comparative Example |
| 37 | 3 | 11 | ○ | 150 | Comparative Example |

[Evaluation Methods]

A commercially available multifunctional peripheral apparatus "bizhub PRO 6501" (made by Konica Minolta, Inc.) was modified so that normal-rotation development can be achieved. By using this apparatus, printing was carried out using each of the developers described above, and the occurrence of whitening (white spots) in the lead portions and the development leakage after durability test were evaluated. Each evaluation result is indicated in the above-described Table III.

<Evaluation of Lead Portion Whitening>

The above-described multifunctional peripheral apparatus and the paper for evaluation were left for 2 days in an environment of a temperature of 10° C. and a relative humidity of 10%, then images with a coverage rate of 2.5% were output on 100 sheets of A4 paper. Then, 10 evaluation charts were printed. The evaluation chart had an image structure in which a solid image was printed after a halftone image, and the degree of whitening (white spot) at the trailing edge of the solid image (the boundary between the solid image area and the halftone image) was visually confirmed.

The evaluation criteria were as follows. The evaluation results of C), 0, A were decided as being acceptable as having no problem for practical use.

◎: Whitening is hardly found

○: Whitening is slightly found (the rear end portion is recognized to be hazy

Δ: Whitening is clearly confirmed (the width of whitening is not more than 1.0 mm)

X: Whitening is distinctively confirmed (the width of whitening is more than 1.0 mm)

<Evaluation of Development Leakage>

The character images with a coverage rate of 5% were output on 100 sheets of paper in an environment of a temperature of 20° C. and a relative humidity of 50%. Then, the developing bias was set so that the adhesion amount was 4.0 g/m$^2$. After that, a solid image was output, and it was confirmed whether an obvious development leakage occurred. The developing bias was raised by 50 V every time to the minus side, and it was confirmed similarly whether or not a development leakage occurred by a solid image, and the lowest developing bias at which development leakage occurred and ΔV of the initial developing bias were compared. When this ΔV was 200 V or more, it was regarded as acceptable as having no problem in practical use.

As exhibited in Table III, the developer (the two-component developer for electrostatic latent image development) of the present invention is capable of suppressing the occurrence of whitening (white spot) in the initial lead portion, and is capable of suppressing occurrence of development leakage even when it is used for a long time. In contrast, the comparative developer (two-component developer for electrostatic latent image development) was inferior to any one of the evaluation items.

What is claimed is:

1. A two-component developer for developing an electrostatic latent image comprising:

toner particles each containing a toner mother particle having an external additive on a surface of the toner mother particle; and carrier particles each having a core material particle and a covering layer containing a resin on a surface of the core material particle, wherein the external additive contains inorganic particles;

the inorganic particles are subjected to surface modification with silicone oil;

a carbon content remained on a surface of the inorganic particle after the surface modification is in the range of 3.0 to 10.0 mass %;

a free carbon ratio on the surface of the inorganic particle is 70.0% or more;

the carrier particles have a resistance in the range of $1.0\times10^{9}$ to $5.0\times10^{10}$ Ω·cm;

the resin in the covering layer comprises a resin formed from a monomer containing an alicyclic methacrylic acid ester monomer; and the toner mother particle includes a binder resin containing an amorphous vinyl resin and a crystalline resin.

2. The two-component developer for developing an electrostatic latent image described in claim 1, wherein the silicone oil is dimethyl silicone oil.

3. The two-component developer for developing an electrostatic latent image described in claim 1, wherein the silicone oil has a kinetic viscosity in the range of 50 to 500 $mm^2/s$ at 25° C.

4. The two-component developer for developing an electrostatic latent image described in claim 1, wherein the inorganic particles have a number average primary-particle diameter in the range of 25 to 100 nm.

5. The two-component developer for developing an electrostatic latent image described in claim 1, wherein the inorganic particles are at least one of silica particles and aluminum oxide particles.

6. The two-component developer for developing an electrostatic latent image described in claim 1, wherein the core material particles in the carrier particles have a resistance in the range of $8.0\times10^{6}$ to $3.0\times10^{8}$ Ω·cm.

7. The two-component developer for developing an electrostatic latent image described in claim 1, wherein the carrier particles have a resistance in the range of $5.0\times10^{9}$ to $2.0\times10^{10}$ Ω·cm.

8. The two-component developer for developing an electrostatic latent image described in claim 1, wherein the covering layer consists of the resin formed from a monomer containing an alicyclic methacrylic acid ester monomer.

9. The two-component developer for developing an electrostatic latent image described in claim 1, wherein a content of the alicyclic methacrylic acid ester monomer that forms the covering layer is in the range of 25 to 75 mass %.

* * * * *